US005143340A

United States Patent [19]

Wood et al.

[11] Patent Number: 5,143,340

[45] Date of Patent: Sep. 1, 1992

[54] LOAD SUPPORT

[75] Inventors: Richard R. Wood, Johannesburg; Norman J. Cook; John R. Thorpe, both of Natal, all of South Africa

[73] Assignee: Fosroc International Limited, Birmingham, Great Britain

[21] Appl. No.: 824,689

[22] Filed: Jan. 21, 1992

Related U.S. Application Data

[63] Continuation of Ser. No. 530,670, May 30, 1990, abandoned.

[30] Foreign Application Priority Data

May 30, 1989 [ZA] South Africa ..... 89/4085

[51] Int. Cl.[5] ..... E21D 15/00

[52] U.S. Cl. ..... 248/354.2; 405/289

[58] Field of Search ..... 248/354.1, 351, 354.2; 405/289

[56] References Cited

U.S. PATENT DOCUMENTS 1,752,101 3/1930 Meutsch ..... 248/354.1

4,036,024 7/1977 Dreker et al. ..... 405/289 X

FOREIGN PATENT DOCUMENTS 3242133 5/1984 Fed. Rep. of Germany ..... 405/289

3336153A1 5/1985 Fed. Rep. of Germany .

2327392 5/1977 France .

0617604 7/1978 U.S.S.R. ..... 405/289

1357582 12/1987 U.S.S.R. ..... 405/289

2091314A 6/1982 United Kingdom .

2131850A 6/1984 United Kingdom .

*Primary Examiner*—Alvin C. Chin-Shue

*Attorney, Agent, or Firm*—Caesar, Rivise Bernstein, Cohen & Pokotilow, Ltd.

[57] ABSTRACT

A support between the floor (22) and the roof (24) of e.g. a mine stope, is made by using an inflatable container comprising an inner bag (10), received in an outer bag (12). An inlet valve (14) extends through both bags as does a relatively higher pressure relief outlet valve (16). In use, air is pumped into the container until it is fully inflated, following by a grout, the air escaping via the valve (16) until the inner bag (10) is filled.

10 Claims, 1 Drawing Sheet

LOAD SUPPORT

Figure 1:
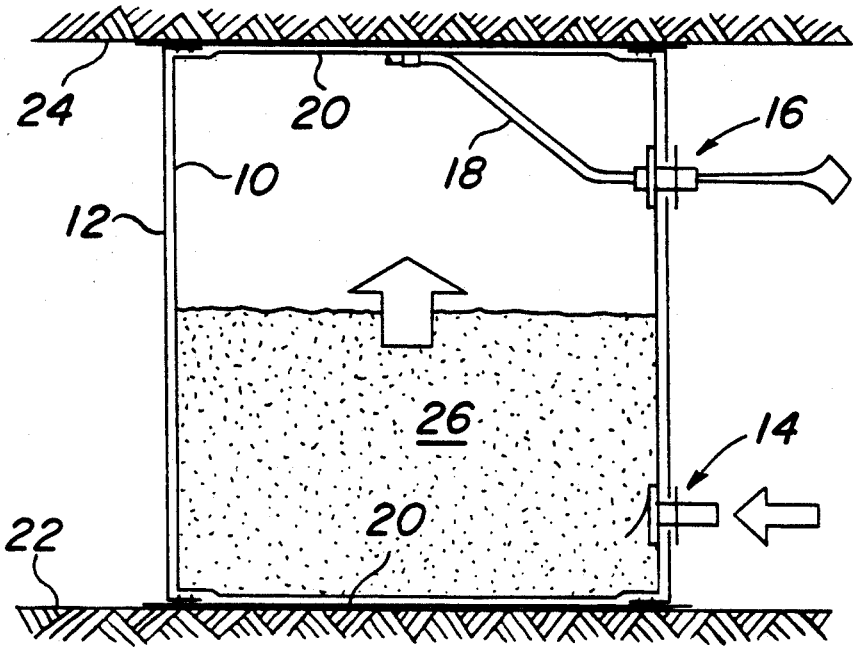

This application is a continuation of application Ser. No. 530,670 filed May 30, 1990 now abandoned.

The invention relates to the erection of a load bearing support between the floor and roof of a structure. More particularly the invention relates to a pillar bag type load support for location between the foot wall and hanging wall or roof in a mine or like structure and to a method of erecting the support.

Pillar bag type mine supports usually consist of a bag of flexible material which is located at one end adjacent the hanging wall in the mine and is supported over its vertical length by metal hoops or other reinforcing structure against expansion in a transverse direction when filled with a settable material such as a liquid grout, slimes or the like. Supports of this type are generally expensive because of the associated elaborate reinforcing structures and the labour involved in their erection.

Another problem associated with such supports is caused by the water pervious material from which the bags are made; this is necessary to enable the grout or slime which is pumped into it to de-water. De-watering of the settable material causes the upper end of the support to shrink away from the hanging wall and even if this were not so it is almost practically impossible to fill the known bags to an extent to which their upper ends bear and remain bearing against the hanging. When the settable material has cured sufficiently (which will take many hours, even days), timber wedges are rammed into the gap between the upper end of the pillar support and the hanging to make the support load supporting. In some mines the unsupported hanging, during the curing period of the settable material in the pillar supports, is dangerous.

It is one object of this invention to provide a pillar bag type load support in which the above problems are reduced or eliminated.

In one aspect the invention provides a method of providing a load support between the floor and the roof of a structure, the method comprising: placing an inflatable container in the space between the floor and the roof, the container having an inlet valve and a pressure relief outlet valve, the valves being spaced apart and in use arranged with the outlet valve uppermost; introducing a gas via the inlet valve to expand the container towards the floor and the roof; supplying a settable material into the container via the inlet valve while allowing the gas to escape via the outlet valve until the container contains sufficient settable material under pressure to support the roof relative to the floor.

Preferably the invention provides a method of erecting a load support including the steps of locating a waterproof bag which includes a filler valve and a pressure relief valve between two vertically spaced surfaces, inflating the bag with air until it bears on both surfaces and pumping a settable material into the inflated bag progressively to displace the air in the bag through the pressure relief valve until the bag is filled with settable material under pressure to bear under pressure against and support the upper of the two surfaces over the first.

In another aspect the invention provides an inflatable container for use in providing a load support between the floor and roof of a structure, the container comprising a bag having a one way inlet valve, wherein the bag is formed of water impervious material and includes a pressure relief outlet valve, and is received within an outer bag formed of reinforced flexible material, the valves extending through both inner and outer bags.

Preferably the material of the outer bag is woven from a plastics material in the form of an unseamed tube the axis of which lies in the direction of load on the support in use, and including means closing the open ends of the outer bag to contain the inner bag. Preferably the weft threads of the weave of the outer bag are circumferential to the bag tube and have a significantly higher tensile strength than the warp threads of the bag weave.

If one specific embodiment of the container of the invention the inner bag is made from an unseamed tubular plastics material with the open ends of the tube heat sealed to seal the bag. The container inlcludes an envelope in the form of an open ended tube which is woven from a plastics material and in which the inner bag is located with the valves passing through the wall of the envelope and outer bag, the sealed ends and the portions of the envelope between which they are located being folded out of the axial direction of the inner bag tube so that the sealed ends of the inner bag will be squeezed between the end portions of the envelope tube and not be exposed to settable material introduced under pressure into the container.

In a preferred form of the invention the container includes a flexible tube which has one end portion attached to the inner surface of the outer bag at what is to be its upper end in use and its other end attached to the pressure relief valve in the wall of the bag so that all air will be exhausted from the container when the bag is filled with a settable material.

Figure 2:
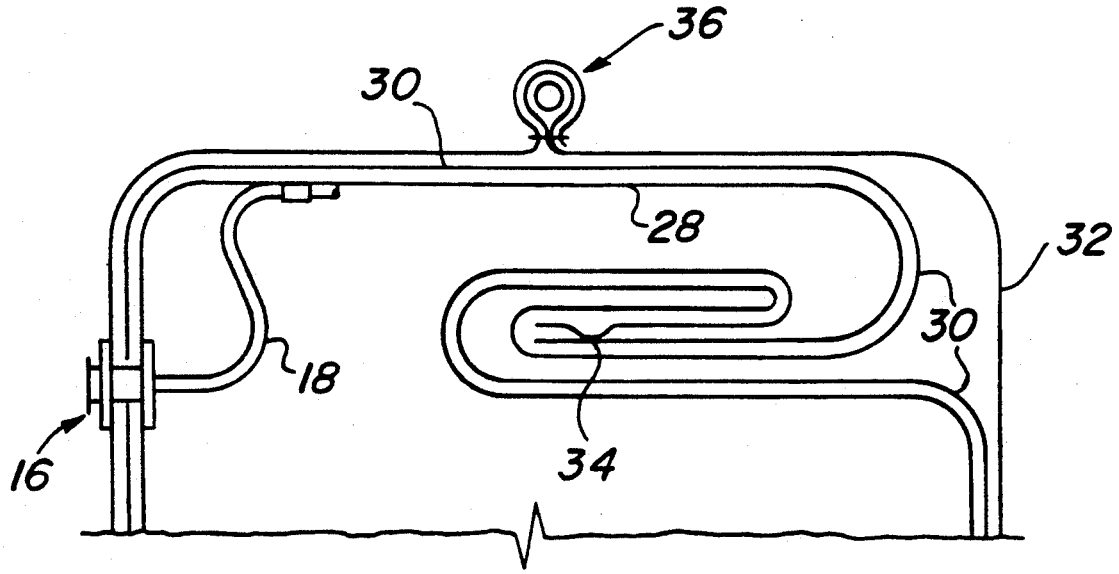

The invention is now described by way of example only with reference to the accompanying diagrammatic drawings in which:

FIG 1 is a side elevation partly in section of one embodiment of the container of the invention, and FIG. 2 is a fragmentary sectional view of the upper end of a second embodiment of the container of the invention.

The container of FIG. 1 comprises an inner bag (10) and an outer bag (12), a one way filler valve (14) and a pressure relief valve (16) being present in a common side wall.

The bag (10) is made from a water impervious plastics material with the valves (14) and (16) bonded by suitable means to a side wall. Preferably the valve (14) is located at a low level in the side wall and the pressure relief valve (16) at a high level. Preferably the valve (16) is connected to a flexible plastics tube (18) which is secured to the upper inner wall of the inner bag.

The outer bag (12) is made from a robust plastics material which is preferably woven in form of a tube with the weft threads of the weave being circumferential to the tube and of a significantly higher tensile strength than the warp threads of the tube. In this embodiment of the invention end pieces (20) are sewn on to the upper and lower edges of the tubular wall of the bag (12) to close the container. To preserve the integrity of the weft threads of the bag slits are made in the wall of the bag between the weft threads to provide apertures through which the valves (14) and (16) are pressed.

In use, the deflated container is located between the foot wall (22) and hanging wall or roof (24) in a mine stope. The container is then inflated with air thorough the one-way filler valve (14) until it is bearing lightly on both the hanging and foot walls. With the now self supported container only partially inflated it may be moved about between the hanging and foot walls to be located in an optimum position against the hanging and footwall in the stope and when so located is further air filled to its design pressure beyond which the valve (16) will blow down to relieve the excess pressure from the container. With the container fully inflated , which is indicated by the blow down of the valve (16), the container is firmly located between the hanging and foot walls in its position of use. Liquid grout or other settable liquid materials is then pumped into the container through the filler valve (14) with the air in the bag being displaced through the tube (18) and the exhaust pressure relief valve (16) as the grout fills the container. The container is filled until the settable material emerges from the valve (16) to indicate that the support is totally filled with grout to its design pressure.

The container shown in FIG. 1 having filling pressure of 2 bar, and a 1 meter diameter, will generate pre-load force of 25 tonnes on the hanging. As no water leakage takes place the support is immediately available at this pre-loaded pressure. The high tensile weft threads of the bag (12) prevent the filled container from bulging in a direction transverse to the support axis.

A suitable grout for use in the container of the invention is a highly liquid and therefore easy to pump grout known as "high yield grout". One example of such a grout, which does not need to be de-watered to cure, is a mixture of high alumina cement (calcium aluminate) and anhydrite (calcium sulphate) which is mixed with water at a very high water to powder ratio, typically in the region of about 2 to 2,5:1 water to powder. Other hydratable materials may be present in addition or instead, e.g. Ordinary Portland cement, pozzolanic materials such a slag, etc. The mixture may and preferably does contain other additives to control set time, viscosity and like properties.

The embodiment shown in FIG. 2 is similar to that of FIG. 1 but includes a significantly more robust bag construction. This container consists of an inner waterproof bag (28) and two reinforced bags (30 and 32) in which the bag (28) is located.

The bag (28) is made from a water imperious plastics material and is formed from an unseamed tube of the material which is heat welded at (34) to close its open upper and lower ends.

The bags (30 and 32) are each made from a suitable non-stretch plastics material which is woven into the form of a tube with the weft threads of the weave being circumferential to the tube and significantly stronger than the warp threads of the tube.

The bag (28) is first located in the bag (30) and the ends of the bags are folded over as shown in the drawings so that the welds (34) of the bag (28) are located between the folds of the bags as shown in the drawing and are not exposed to the inside of the bag (28). Obviously, in use the entire fold arrangement of the two inner bags would lie flat up against the upper wall of the container and not be spaced from it as shown in the drawing which is so drawn only for simplicity of illustration. The folded inner bags are then located in the outer bags (32) which then has its upper and lower ends seam stitched or closed in any other suitable manner as indicated (36) to close the composite container. The container of FIG. 2 includes the filling and pressure relief valves as illustrated in FIG. 1 with the valves passing through slit apertures in the two outer bags of the support.

In use the container of FIG. 2 is filled with grout in the same manner as that described with reference to FIG. 1 with the high pressure grout at no stage coming into contact with stitching on any of the bags or the relatively weak welds (34) of the inner bag which are now tightly sandwiched between the folds of the envelope (30) up against the upper and lower internal walls of the support.

It has been found in experiments with the bag of FIG. 2 that because of the strength of the support bag due to the circumferential direction of the weft threads of the bags (30 and 32) and the fact that the inner bag is not exposed to any bag stitching, the support is capable of withstanding internal pressures of between 4 and 6 bar. There is no leakage of liquid from the bag, nor any loss of the considerable pre-load forces which are generated at these pressures between the foot and hanging walls (22 and 24).

What is claimed as the invention is:

1. A method of providing a load support between a floor and a roof of a structure, the method comprising: placing a container having an inflatable water impervious bag with an interior compartment in a space between the floor and the roof, the container having both an inlet valve and a pressure relief outlet valve communicating with the interior compartment, the valves being spaced apart and in use arranged with the outlet valve uppermost; locating the container at a desired location for providing the load support; introducing a gas via the inlet valve into the interior compartment until gas escapes through the pressure relief outlet valve to fully expand the container free of any support to its side walls toward the floor and the roof; supplying a settable material into the water impervious bag of said container via the inlet valve while allowing the gas to escape via the outlet valve until the container contains sufficient settable material under pressure to support the roof relative to the floor, said water impervious bag allowing the material to set therein without allowing leakage of liquid therefrom.

2. A method according to claim 1, wherein the introduced gas is air.

3. A method according to claim 1, wherein the container comprises an inner water impervious bag inside an outer bag which is of greater tensile strength, and the inlet and pressure relief valves extend through the walls of both bags.

4. A method according to claim 1, wherein the container comprises an inner water impervious bag having welded ends, the inner bag being received in an envelope in an outer bag, such that the sealed ends of the inner bag are shielded from the introduced settable material.

5. A method according to claim 1, wherein the settable material within the water impervious bag includes water and is formulated so that the water does not need to be removed when the settable material sets and cures .

6. A method according to claim 5, wherein the hydraulically settable material comprises water and cementitious material.

7. A method according to claim 6, wherein the hydraulically settable material comprises water and a cementitious material in a weight ratio of about 2 to about 2.5:1.

8. A method according to claim 6, wherein the cementitious material comprises a mixture of high alumina cement and a calcium sulphate, Ordinary Portland cement or pozzolanic material.

9. The method according to claim 1, including the step of initially introducing a gas via the inlet valve into the interior compartment to only partially inflate the container into a self supported structure prior to locating the container at the desired location for providing the load support.

10. The method according to claim 1, including the step of supplying the settable material into the waterproof bag of said container via the inlet valve until settable material emerges from the outlet valve, whereby the container is completely filled with the settable material under pressure for supporting the roof relative to the floor.

* * * * *